US011667135B2

(12) United States Patent
Suzuki

(10) Patent No.: US 11,667,135 B2
(45) Date of Patent: Jun. 6, 2023

(54) LIQUID DISCHARGE DEVICE AND IMAGE FORMING DEVICE

(71) Applicant: Katsuhiko Suzuki, Kanagawa (JP)

(72) Inventor: Katsuhiko Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 17/658,860

(22) Filed: Apr. 12, 2022

(65) Prior Publication Data

US 2022/0324238 A1 Oct. 13, 2022

(30) Foreign Application Priority Data

Apr. 13, 2021 (JP) ..... JP2021-067698

(51) Int. Cl.
*B41J 11/00* (2006.01)
*B41M 7/00* (2006.01)

(52) U.S. Cl.
CPC ..... *B41J 11/002* (2013.01); *B41J 11/007* (2013.01); *B41M 7/009* (2013.01)

(58) Field of Classification Search
CPC ... B41J 11/002; B41J 11/007; B41J 11/00242; B41J 15/16; B41J 15/04; B41M 7/009
See application file for complete search history.

(56) References Cited

U.S. PATENT DOCUMENTS

2013/0038656 A1* 2/2013 Mizutani ..... B41J 11/0095 347/16
2018/0267756 A1 9/2018 Lee

FOREIGN PATENT DOCUMENTS

| | | |
|---|---|---|
| JP | H04-173342 | 6/1992 |
| JP | 2008-094556 | 4/2008 |
| JP | 2009-078886 | 4/2009 |
| JP | 2010-120754 | 6/2010 |
| JP | 2013-103383 | 5/2013 |
| JP | 2018-122520 | 8/2018 |
| JP | 2018-156244 | 10/2018 |

* cited by examiner

*Primary Examiner* — Bradley W Thies
(74) *Attorney, Agent, or Firm* — IPUSA, PLLC

(57) ABSTRACT

A liquid discharge device determines, in a state of a liquid discharger discharging liquid onto a continuous form sheet conveyed by a conveyor at a first conveying speed, in response to a seam of the continuous form sheet detected by a seam detection sensor, whether a heater temperature detected by a temperature detection sensor is a threshold or higher; causes, in response to the heater temperature being determined to be the threshold or higher, the conveyor to stop conveying the continuous form sheet, until the heater temperature decreases to be less than the threshold; and causes, in response to the heater temperature having decreased to be less than the threshold, the conveyor to convey the continuous form sheet at a second conveying speed slower than the first conveying speed until the seam of the continuous form sheet is wound up around a winding roller.

6 Claims, 3 Drawing Sheets

LIQUID DISCHARGE DEVICE AND IMAGE FORMING DEVICE

CROSS-REFERENCE TO RELATED APPLICATIONS

The present application is based upon and claims the benefit of priority under 35 U.S.C. § 119 of Japanese Patent Application No. 2021-067698 filed on Apr. 13, 2021, the entire contents of which are hereby incorporated by reference.

BACKGROUND OF THE INVENTION

1. Field of the Invention

The present disclosure relates to a liquid discharge device and an image forming device.

2. Description of the Related Art

Conventionally, an image forming device has been known that includes a conveyor configured to convey a continuous form sheet; an ink discharge unit configured to discharge ink onto the continuous form sheet conveyed by the conveyor; and a dryer configured to dry the ink adhering to the continuous form sheet (see, for example, Patent Documents 1 to 3).

Also, the image forming device configured as described above sets the heater temperature of the dryer higher as the conveying speed of the continuous form sheet of the conveyor becomes faster, to dry the ink adhering to the continuous form sheet properly.

Further, in the image forming device configured as described above, in the case where the remaining continuous form sheet before image formation decreases to a certain extent, by attaching the front end of a new continuous form sheet to the rear end of the old continuous form sheet by a tape or the like, the continuous form sheets are connected to be wound by a winding device. In this way, a continuous form sheet is supplied to continue image formation.

Here, when a seam of the continuous form sheet passes by the dryer in a state of the heater temperature being high, there is a likelihood that the tape connecting the continuous form sheets peels off, and the seam of the continuous form sheet breaks. As a result, in order to reconnect the broken continuous form sheets, the image forming device needs to be stopped, and a problem arises in that that the downtime is long.

SUMMARY OF THE INVENTION

According to one aspect of the present invention, a liquid discharge device includes: a conveyor including an unwinding roller to rotate in a direction in which a continuous form sheet being wound is unwound, and a winding roller to rotate in a direction in which the continuous form sheet unwound and fed from the unwinding roller is wound, and configured to convey the continuous form sheet from the unwinding roller to the winding roller; a liquid discharger arranged between the unwinding roller and the winding roller in a conveying direction of the continuous form sheet, and configured to discharge liquid onto the continuous form sheet; a dryer arranged between the liquid discharger and the winding roller in the conveying direction of the continuous form sheet, and configured to dry the liquid adhering to the continuous form sheet, setting a heater temperature higher as a conveying speed of the continuous form sheet by the conveyor becomes faster; a seam detection sensor arranged between the unwinding roller and the liquid discharger in the conveying direction of the continuous form sheet, and configured to detect a seam of the continuous form sheet; a temperature detection sensor configured to detect the heater temperature; and a controller including a memory and a processor configured to control the conveyor based on detection results of the seam detection sensor and the temperature detection sensor. The controller determines, in a state of the liquid discharger discharging the liquid onto the continuous form sheet being conveyed by the conveyor at a first conveying speed, in response to a seam of the continuous form sheet being detected by the seam detection sensor, whether the heater temperature detected by the temperature detection sensor is higher than or equal to a threshold temperature. The controller causes, in response to the heater temperature being determined to be higher than or equal to the threshold temperature, the conveyor to stop conveying the continuous form sheet, until the heater temperature falls below the threshold temperature. The controller causes, in response to the heater temperature having fallen below the threshold temperature, the conveyor to convey the continuous form sheet at a second conveying speed that is slower than the first conveying speed until the seam of the continuous form sheet is wound up around the winding roller.

DETAILED DESCRIPTION OF THE EMBODIMENTS

According to the present invention, in a liquid discharge device discharging a liquid onto a continuous form sheet, the continuous form sheet can be prevented from breaking at a seam.

Figure 1:
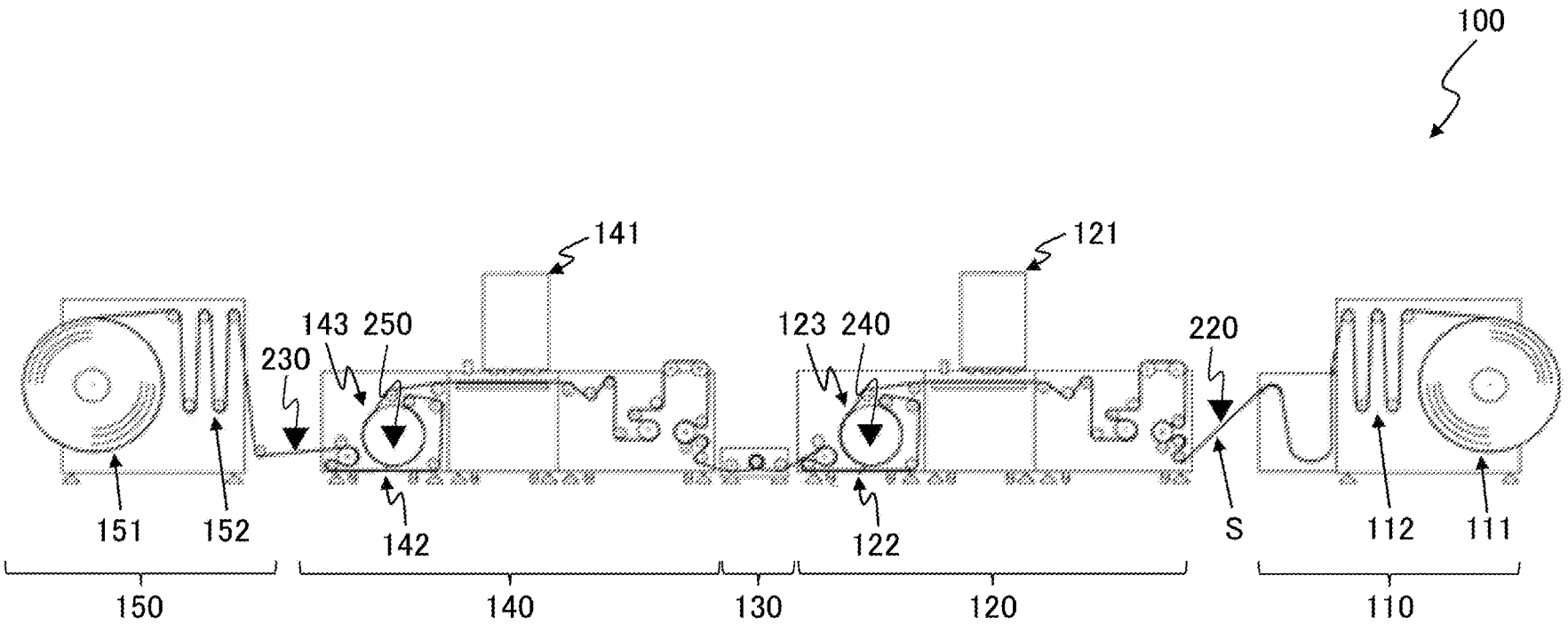
FIG. 1 is a diagram illustrating an overall configuration of an inkjet printer.

In the following, an inkjet printer 100 as an embodiment of a liquid discharge device and an image forming device according to present invention will be described with reference to the drawing. FIG. 1 is a diagram illustrating an overall configuration of the inkjet printer 100. The inkjet printer 100 illustrated in FIG. 1 is a line engine printer using an ink jet system.

The inkjet printer 100 can form images on both sides of a continuous form sheet S having a long strip shape. Also, the inkjet printer 100 can form images on both sides of the continuous form sheet S (the upside and the underside). Further, in the case of forming images on both sides of the continuous form sheet S, the inkjet printer 100 can execute drying in two stages, namely, drying after forming images on the upside, and drying after forming images on the underside. As illustrated in FIG. 1, the inkjet printer 100 includes a paper feeding device 110, an upside image forming device 120, an upside down turning unit 130, an underside image forming device 140, a paper winding device 150, and a controller 200 (see FIG. 2).

The paper feeding device 110 includes an unwinding roller 111 that holds the continuous form sheet S wound in a roll, and rotates in a direction in which the wound continuous form sheet S is unwound at a predetermined speed; and a feeding buffer unit 112 that configures a buffer region corresponding to fluctuation in the conveying speed of the continuous form sheet S. The paper feeding device 110 conveys the continuous form sheet S to a position at which droplets discharged from recording heads provided in the upside image forming device 120 and in the underside image forming device 140, can be adhered.

The upside image forming device 120 includes an upside image forming unit 121 (a first liquid discharger) that includes recording heads to discharge liquid ink as liquid droplets onto a first side as the upside of the continuous form sheet S, and an upside dryer 122 (a first dryer) to dry upside images formed on the first side. The upside image forming unit 121 is arranged on the upstream side of the conveying direction of the continuous form sheet S, relative to the upside down turning unit 130. The upside dryer 122 is arranged between the upside image forming unit 121 and the upside down turning unit 130 in the conveying direction of the continuous form sheet S.

The upside image forming unit 121 includes discharge heads to discharge color inks (liquids) of black, cyan, magenta, and yellow as ink droplets. The upside image forming unit 121 discharges ink droplets at predetermined timings onto the continuous form sheet S being conveyed, to form upside images on the upside of the continuous form sheet S. However, the ink droplets immediately after adhering to the upside of the continuous form sheet S are not dried yet.

The upside dryer 122 includes an upside drying drum 123 as a large diameter drum. The upside drying drum 123 includes a heater that receives electric power from the controller 200, to generate heat. When the opposite side (underside) of an image forming surface (upside) of the continuous form sheet S contacts the upside drying drum 123, the droplets. forming an upside image are dried. A conveying roller that rotates while contacting the underside of the continuous form sheet S, is arranged around the upside drying drum 123. The continuous form sheet S dried by the upside drying drum 123 is transferred to the upside down turning unit 130.

The upside down turning unit 130 is an example of a turning unit that turns upside down the positions of the upside and the underside of the continuous form sheet S. The continuous form sheet S turned by the upside down turning unit 130 is transferred to the underside image forming device 140, in a state of the underside coming on top and the upside having upside images formed coming underneath.

The underside image forming device 140 includes an underside image forming unit 141 (a second liquid discharger) that includes recording heads to discharge liquid ink as liquid droplets onto a second side as the upside of the continuous form sheet S when transferred from the paper feeding device 110; and an underside dryer 142 (a second dryer) to dry underside images formed on the second side. The underside image forming unit 141 is arranged on the downstream side of the conveying direction of the continuous form sheet S, relative to the upside down turning unit 130. The underside dryer 142 is arranged between the underside image forming unit 141 and the paper winding device 150 in the conveying direction of the continuous form sheet S.

The underside image forming unit 141 includes discharge heads to discharge color inks (liquids) of black, cyan, magenta, and yellow as ink droplets. The underside image forming unit 141 discharges ink droplets at predetermined timings onto the continuous form sheet S being conveyed, to form underside images on the underside of the continuous form sheet S. However, the ink droplets immediately after adhering to the underside of the continuous form sheet S are not dried yet.

The underside dryer 142 includes an underside drying drum 143 as a large diameter drum. The underside drying drum 143 includes a heater that receives electric power from the controller 200, to generate heat. When the opposite side (upside) of an image forming surface (underside) of the continuous form sheet S contacts the underside drying drum 143, the droplets forming an underside image are dried. A conveying roller that rotates while contacting the upside of the continuous form sheet S, is arranged around the underside drying drum 143. The continuous form sheet S dried by the underside drying drum 143 is transferred to the paper winding device 150.

The paper winding device 150 includes a winding roller 151 that rotates in a direction in which the continuous form sheet S having upside images and underside images formed are wound up in a roll, and a winding buffer unit 152 that configures a buffer region corresponding to fluctuation in the conveying speed of the continuous form sheet S (winding speed).

The paper feeding device 110 and the paper winding device 150 together are an example of a conveyor that conveys the continuous form sheet S between the unwinding roller 111 and the winding roller 151. The upside image forming device 120 and the underside image forming device 140 together are an example of a liquid discharge until that is arranged between the unwinding roller 111 and the winding roller 151 in the conveying direction of the continuous form sheet, to discharge liquid onto the continuous form sheet S. The upside dryer 122 and the underside dryer 142 together are an example of a dryer that is arranged between the liquid discharger and the winding roller 151 in the conveying direction of the continuous form sheet S, to dry the liquid adhering to the continuous form sheet S.

Note that in the inkjet printer 100 configured as described above, the upside down turning unit 130 and the underside image forming device 140 can be omitted. In other words, the continuous form sheet S transferred from the paper feeding device 110 that have images formed by the upside image forming unit 121, and have the adhered ink dried in the upside dryer 122, may be wound up in the paper winding device 150.

Figure 2:
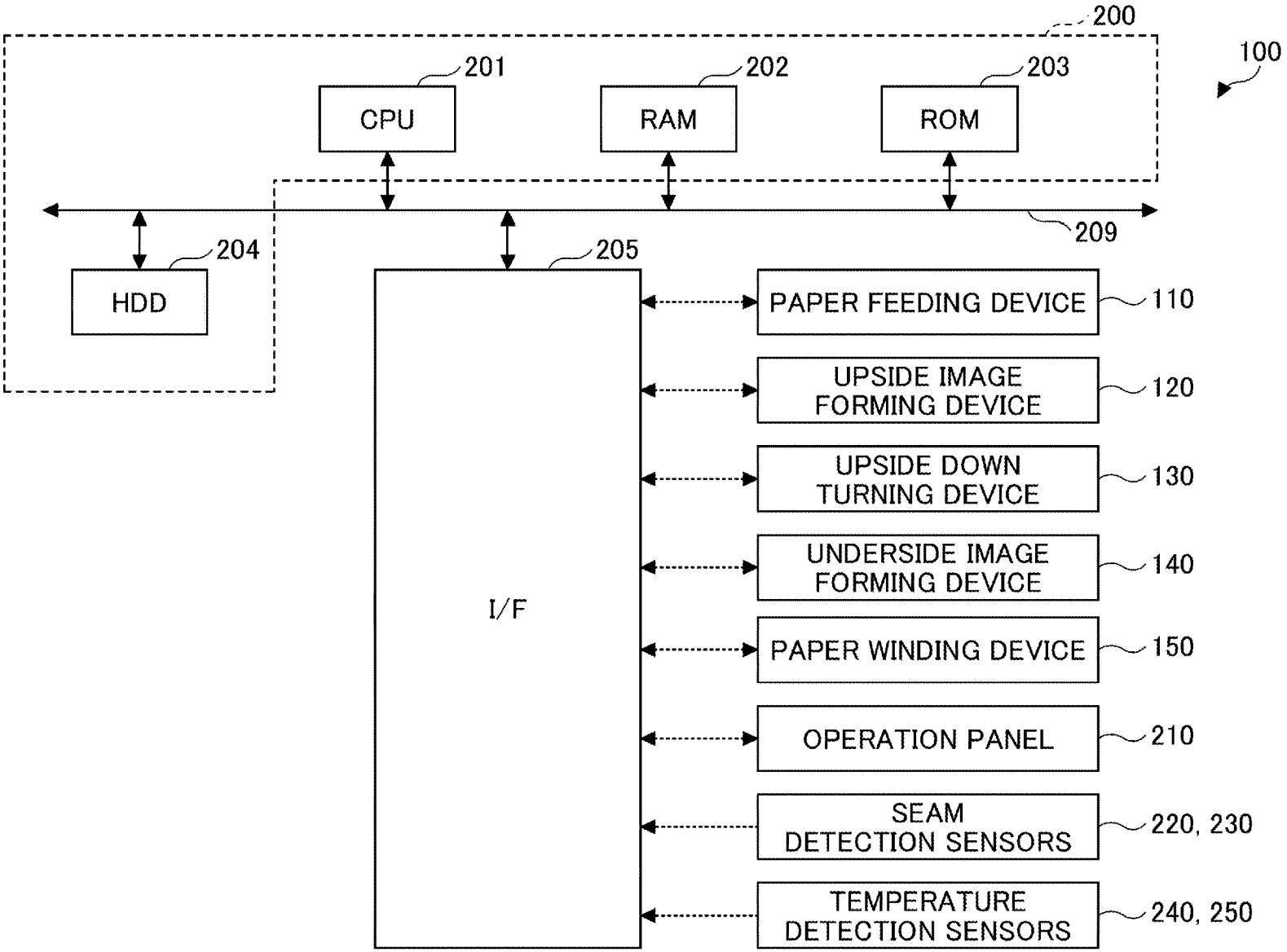
FIG. 2 is a hardware configuration diagram of the inkjet printer.

FIG. 2 is a hardware configuration diagram of the inkjet printer 100. As illustrated in FIG. 2, the inkjet printer 100 has a configuration that includes a central processing unit (CPU) 201, a random access memory (RAM) 202, a read-only memory (ROM) 203, a hard disk drive (HDD) 204, and an interface (I/F) 205 that are connected to one another via a common bus 209.

The CPU 201 is an arithmetic/logic to control operations of the entire inkjet printer 100. The RAM 202 is a volatile storage medium that can read and write information at high speed, and is used as a work area when the CPU 201 processes information. The ROM 203 is a read-only non-volatile storage medium, to store programs such as firmware. The HDD 204 is a non-volatile storage medium that can read and write information and has a large storage capacity, to store an operating system (OS), various types of control programs, application programs, and the like.

The inkjet printer 100 processes a control program stored in the ROM 203; an information processing program (application program) loaded into the RAM 202 from a storage medium such as the HDD 204; or the like, by arithmetic/logic functions provided in the CPU 201. The processing configures a software control unit including various functional modules of the inkjet printer 100. By combining the software control unit configured in this way with the hardware resources installed in the inkjet printer 100, functional blocks that implement the functions of the inkjet printer 100 are configured. In other words, the CPU 201, the RAM 202, the ROM 203, and the HDD 204 constitute the controller 200 that controls operations of the inkjet printer 100.

The I/F 205 is an interface that connects the paper feeding device 110, the upside image forming device 120, the upside down turning unit 130, the underside image forming device 140, the paper winding device 150, the operation panel 210, the seam detection sensors 220 and 230, and the temperature detection sensors 240 and 250, to the common bus 209.

In addition, the controller 200 controls the paper feeding device 110, the upside image forming device 120, the upside down turning unit 130, the underside image forming device 140, and the paper winding device 150 through the I/F 205, to execute an image forming process that forms an image represented in image data onto the continuous form sheet S. Also, the controller 200 executes input and output of information with an operator of the inkjet printer 100 through the operation panel 210. Further, the controller 200 identifies the state of the inkjet printer 100, based on detection results of the seam detection sensors 220 and 230 and the temperature detection sensors 240 and 250.

The operation panel 210 includes an operation unit to receive an input operation from the operator and a display (an informing unit) to inform the operator of information. The operation unit includes, for example, hardware keys, a touch panel superimposed on the display, and the like. Also, the specific example of the informing unit is not limited to a display, and may be LED lamps, speakers, and the like.

Each of the seam detection sensors 220 and 230 detects a seam of the continuous form sheet S, and outputs to the controller 200 a seam signal indicating that the seam has been detected. As the seam detection sensors 220 and 230, for example, a transmissive sensor using a photo interrupter can be adopted. More specifically, each of the seam detection sensors 220 and 230 includes a light emitting unit and a light receiving unit arranged to face each other across the continuous form sheet S.

A seam of the continuous form sheet S is in a state of having the tail end of an old continuous form sheet S connected with the front end of a new continuous form sheet S, for example, by an adhesive member such as a seal. This seal as the adhesive member is a material having a smaller transmission amount of light than the continuous form sheet S. Therefore, the amount of light transmitted from one side to the other side of the seamed portion of the continuous form sheet S is less than the amount of light transmitted through the continuous form sheet S in the same direction.

Therefore, as an example, each of the seam detection sensors 220 and 230 outputs a seam signal in the case where the amount of light received by the light receiving unit is below a threshold value. As another example, each of the seam detection sensors 220 and 230 may output an amount of light received by the light receiving unit to the controller 200. Then, the controller 200 may determine that a seam of the continuous form sheet S has passed by the installation positions of the seam detection sensors 220. and 230, in the case where the amounts of light output from the seam detection sensors 220 and 230 are below the threshold value.

The seam detection sensor 220 is arranged between the paper feeding device 110 and the upside image forming device 120 in the conveying direction of the continuous form sheet S. In other words, the seam detection sensor 220 detects a seam passing by the detection position in the conveying direction of the continuous form sheet S on the upstream side relative to the upside image forming device 120. In other words, the seam detection sensor 220 detects that the seam has been unwound and fed from the unwinding roller 111.

The seam detection sensor 230 is arranged between the underside image forming device 140 and the paper winding device 150 in the conveying direction of the continuous form sheet S. In other words, the seam detection sensor 230 detects a seam passing by the detection position in the conveying direction of the continuous form sheet S on the downstream side relative to the underside image forming device 140. In other words, the seam detection sensor 230 detects that a seam has passed by the underside image forming device 140 (more specifically, the underside dryer 142).

Each of the temperature detection sensors 240 and 250 detects the temperature of the heater provided in each of the upside dryer 122 and the underside dryer 142 (hereafter, referred to as the "heater temperature"), and outputs a temperature signal indicating the detected heater temperature to the controller 200. As the temperature detection sensors 240 and 250, for example, a thermistor or the like may be adopted.

Figure 3:
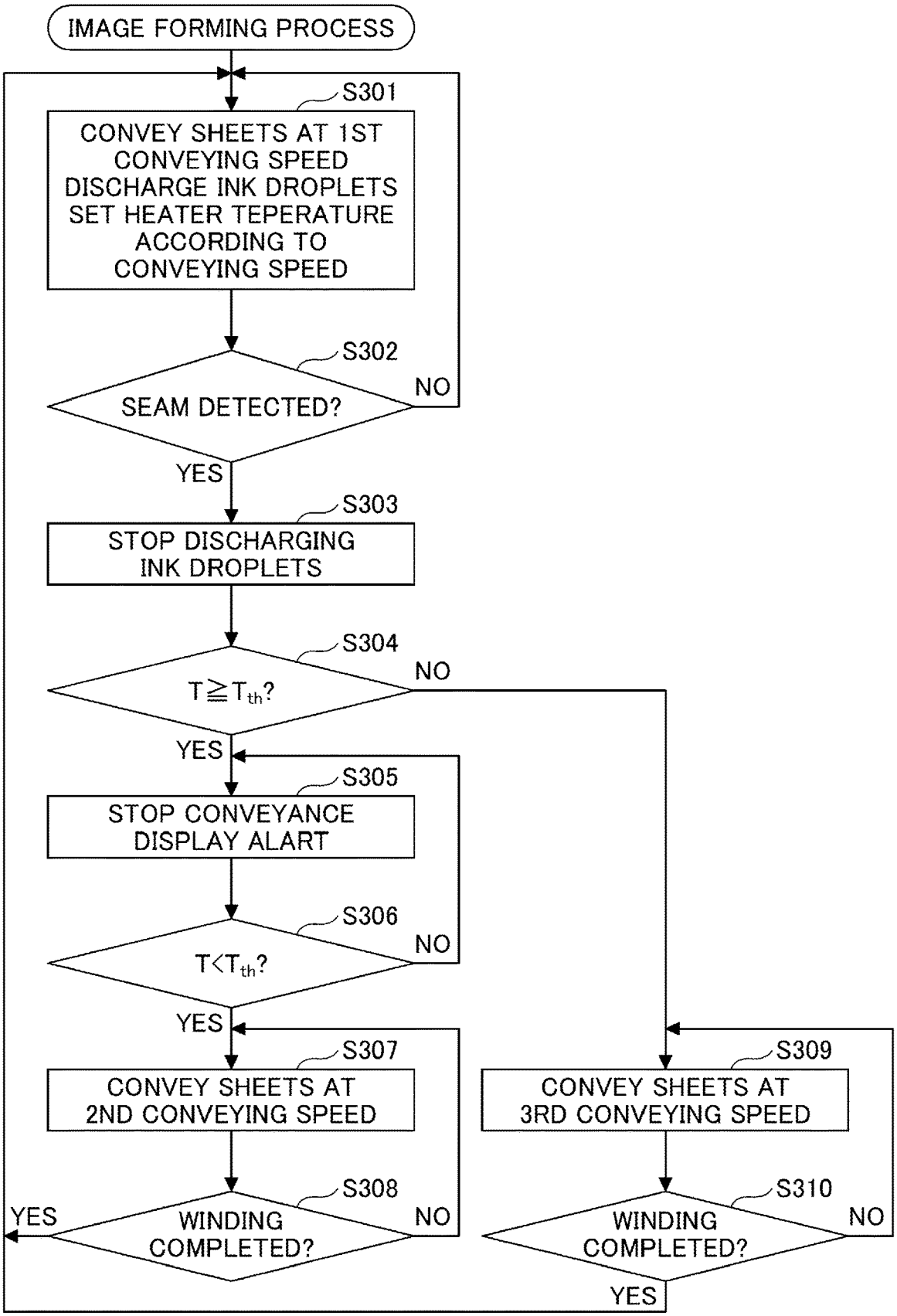
FIG. 3 is a flowchart of an image forming process.

With reference to FIG. 3, an image forming process executed by the controller 200 will be described. FIG. 3 is a flowchart of the image forming process. The image forming process is a process of repeatedly forming images represented by input image data onto the continuous form sheet S. The image data may be received, for example, from an external device (e.g., a PC) through a communication interface, or may be generated by a scanner installed in the inkjet printer 100 that reads a document.

First, the controller 200 forms images onto the continuous form sheet S (S301). More specifically, the controller 200 causes the paper feeding device 110 and the paper winding device 150 to convey the continuous form sheet S at a first conveying speed. The first conveying speed is a conveying speed set by the operator through the operation panel 210. In other words, the first conveying speed takes a variable value that is faster than a second conveying speed and a third conveying speed that will be described later. Also, the controller 200 causes the upside image forming unit 121 and the underside image forming unit 141 to discharge ink droplets at predetermined timings, to form images on the upside and on the underside of the continuous form sheet S.

Further, the controller 200 supplies electric power to the respective heaters of the upside dryer 122 and the underside dryer 142, to heat the heaters. At this time, the controller 200 sets the heater temperature according to the conveying speed of the continuous form sheet S. In other words, the controller 200 increases the electric power supplied, to the heaters as the first conveying speed becomes faster (i.e., sets the heater temperature higher), and decreases the electric power supplied to the heaters as the first conveying speed becomes slower (i.e., sets the heater temperature lower).

The controller 200 continues processing at Step S301 until a seam of the continuous form sheet S is detected by the seam detection sensor 220 (NO at Step S302). Accordingly, images represented by the image data are repeatedly formed on the upside and on the underside of the continuous form sheet S, and the continuous form sheet S having the images formed are wound up around the winding roller 151. As a result, the continuous form sheet S wound around the unwinding roller 111 decreases. When the continuous form sheet S wound around the unwinding roller 111 decreases to a certain extent, the operator of the inkjet printer 100 connects the rear end of the continuous form sheet S set in the unwinding roller 111 with the front end of a new continuous form sheet S by a seal, and sets the roll of the newly seamed continuous form sheet S on the unwinding roller 111. Note that the operation described above is performed not only in the case where the continuous form sheet S wound around the unwinding roller 111 decreases, but also in the case of changing the type of continuous form sheet S.

Next, in response to a seam of the continuous form sheet S is detected by the seam detection sensor 220 (YES at Step S302), the controller 200 causes the upside image forming unit 121 and the underside image forming unit 141 to stop discharging ink droplets (S303). Next, the controller 200 determines whether the heater temperature T detected by the temperature detection sensors 240 and 250 is higher than or equal to a threshold temperature $T_{th}$ (S304).

The threshold temperature $T_{th}$ is a temperature below which when a seam of the continuous form sheet S passes by the upside dryer 122 and the underside dryer 142, the seam does not break. The threshold temperature $T_{th}$ is determined in advance by an experiment or simulation, and stored in the HDD 204. Also, the heater temperatures T detected by the temperature detection sensors 240 and 250 take approximately the same value. Therefore, at Step S304, the controller 200 may use only one of the heater temperatures T. detected by the temperature detection sensors 240 and 250, or both. The same applies to Step S306 that will be described later.

Next, if the heater temperature T is determined to be higher than or equal to the threshold temperature $T_{th}$ (YES at Step S304), the controller 200 causes the paper feeding device 110 and the paper winding device 150 to stop conveying the continuous form sheet S (S305). Also, the controller 200 stops supplying electric power to the heaters of the upside dryer 122 and the underside dryer 142, in accordance with having the conveying speed of the continuous form sheet S set to 0. Accordingly, the heater temperature T decreases gradually.

Further, the controller 200 display a message such as "As the heater temperature is high, there is a likelihood that a seam of the continuous form sheet breaks." on the display, to inform that the heater temperature T is high. However, the specific method of informing is not limited to displaying a message on the display, and a LED lamp may be turned on, or an alarm sound may be output from a speaker.

The controller 200 continues processing at Step S305 until the heater temperature T detected by the temperature detection sensors 240 and 250 falls below the threshold temperature $T_{th}$ (NO at Step S306). Then, in response to the heater temperature T detected by the temperature detection sensors 240 and 250 having fallen below the threshold temperature $T_{th}$ (YES at Step S306), the controller 200 causes the paper feeding device 110 and the paper winding device 150 to convey the continuous form sheet S at a second conveying speed (S307). Also, the controller 200 supplies electric power to the heaters of the upside dryer 122 and the underside dryer 142, so that the heater temperature becomes a temperature corresponding to the second conveying speed. Meanwhile, the controller 200 continues to stop discharging ink droplets by the upside image forming unit 121 and the underside image forming unit 141.

The second conveying speed is a value determined in advance at which a seam does not break even when the seam of the continuous form sheet S passes by the upside dryer 122 and the underside dryer 142 whose temperatures are lower than or equal to the threshold temperature $T_{th}$. Also, the second conveying speed is slower than the first conveying speed. Further, the second conveying speed is a value at which the heater temperature T can be set to be lower than the threshold temperature $T_{th}$.

The controller 200 continues processing at Step S307 until the seam of the continuous form sheet S is wound up around the winding roller 151 (NO at Step S308). The controller 200 determines that the seam of the continuous form sheet S is wound up around the winding roller 151, for example, in response to a predetermined time having elapsed since the seam was detected by the seam detection sensor 230. In addition, in response to the seam of the continuous form sheet S having been wound up around the winding roller 151 (YES at Step S308), the controller 200 executes processing at Step S301. In other words, the controller 200 resumes formation of images on the continuous form sheet S.

Meanwhile, if the heater temperature T is determined to be lower than the threshold temperature. $T_{th}$ (NO at Step S304), the controller 200 causes the paper feeding device 110 and the paper winding device 150 to convey the continuous form sheet S at a third conveying speed (S309). Also, the controller 200 supplies electric power to the heaters of the upside dryer 122 and the underside dryer 142, so that the heater temperature becomes a temperature corresponding to the third conveying speed. Meanwhile, the controller 200 continues to stop discharging ink droplets by the upside image forming unit 121 and the underside image forming unit 141.

The third conveying speed is a value determined in advance at which a seam does not break even when the seam of the continuous form sheet S passes by the upside dryer. 122 and the underside dryer 142 whose temperatures are lower than or equal to the threshold temperature $T_{th}$. Also, the third conveying speed is slower than the first conveying speed. Further, the third conveying speed is a value at which the heater temperature T can be set to be lower than the threshold temperature $T_{th}$. Note that the second conveying speed and the third conveying speeds may be the same or may be different.

The controller 200 continues processing at Step S309. until the seam of the continuous form sheet S is wound up around the winding roller 151 (NO at Step S310). The processing at Step S310 is the same as that at Step S308. In addition, in response to the seam of the continuous form sheet S having been wound up around the winding roller 151 (YES at Step S310), the controller 200 executes processing at Step S301. In other words, the controller 200 resumes formation of images on the continuous form sheet S.

According to the embodiments described above, for example, the following effects can be brought.

According to the embodiments described above, if the heater temperature T is higher than or equal to the threshold temperature $T_{th}$ at a timing when a seam of the continuous form sheet S is detected by the seam detection sensor 220, until the heater temperature T falls below the threshold temperature $T_{th}$, conveyance of the continuous form sheet S is temporarily stopped. Then, after the heater temperature T has fallen below the threshold temperature $T_{th}$, conveyance of the continuous form sheet S resumes at the second conveying speed that is slower than the first conveying speed. Accordingly, the seam of the continuous form sheet S can be prevented from breaking when passing by the upside dryer 122 and the underside dryer 142.

Also, according to the embodiment described above, at a timing when a seam of the continuous form sheet S is detected by the seam detection sensor 220, if the heater temperature T is lower than the threshold temperature $T_{th}$, the continuous form sheet S is conveyed at the third conveying speed that is slower than the first conveying speed. Accordingly, the seam of the continuous form sheet S can be prevented from breaking when passing by the upside dryer 122 and the underside dryer 142.

Also, according to the embodiments described above, after a seam of the continuous form sheet S was detected by the seam detection sensor 220 until this seam is wound up around the winding roller 151, discharge of ink droplets by the upside image forming unit 121 and the underside image forming unit 141 is stopped. Accordingly, it becomes possible to prevent the ink droplets from being dried insufficiently as the heater temperature T decreases, that would make the continuous form sheet S wound up around the winding roller 151 stained.

Further, according to the embodiments described above, the operator is informed that the heater temperature T is high for a period during which conveyance of the continuous form sheet S is temporarily stopped. Accordingly, the operator can be made aware of the reason why the conveyance of the continuous form sheet S stops. Note that at Step S305, not only the message described above, but also an estimated time to resume conveyance of the continuous form sheet S may be displayed.

In this case, the inkjet printer 100 may include an ambient temperature sensor to detect the ambient temperature. Then, the controller 200 estimates an estimated time based on the temperature difference between the heater temperature T detected by the temperature detection sensors 240 and 250, and the threshold temperature $T_{th}$; and the ambient temperature detected by the ambient temperature sensor. The estimated time becomes longer for a greater temperature difference, and becomes longer for a higher ambient temperature. The estimated time corresponding to the combination of the temperature difference and the ambient temperatures can be stored in the HDD 204 in advance by an experiment or simulation.

Note that the specific examples of the liquid discharger is not limited to the upside image forming unit 121 and the underside image forming unit 141, and may be a unit that discharges a preprocessing liquid. In other words, the liquid discharge device is not limited to the inkjet printer 100.

Note that the present invention is not limited to the embodiments described above; various changes can be made without departing from the technical substance, and all the technical matters included in the technical concept described in the claims are covered by the present invention. Although the embodiments described above show favorable examples, it is possible for one skilled in the art to implement various modified examples from the disclosed contents. Such modified examples are also included in the technical scope described in the claims.

RELATED ART DOCUMENTS

Patent Documents

[Patent Document 1] Japanese Laid-Open Patent Application 2008-94556

[Patent Document 2] Japanese Laid-Open Patent Application 2009-78886

[Patent Document 3] Japanese Laid-Open Patent Application 2010-120754

What is claimed is:

1. A liquid discharge device comprising:

a conveyor including an unwinding roller to rotate in a direction in which a continuous form sheet being wound is unwound, and a winding roller to rotate in a direction in which the continuous form sheet unwound and fed from the unwinding roller is wound, and configured to convey the continuous form sheet from the unwinding roller to the winding roller;

a liquid discharger arranged between the unwinding roller and the winding roller in a conveying direction of the continuous form sheet, and configured to discharge liquid onto the continuous form sheet;

a dryer arranged between the liquid discharger and the winding roller in the conveying direction of the continuous form sheet, and configured to dry the liquid adhering to the continuous form sheet, setting a heater temperature higher as a conveying speed of the continuous form sheet by the conveyor becomes faster;

a seam detection sensor arranged between the unwinding roller and the liquid discharger in the conveying direction of the continuous form sheet, and configured to detect a seam of the continuous form sheet;

a temperature detection sensor configured to detect the heater temperature; and a controller including a memory and a processor configured to control the conveyor based on detection results of the seam detection sensor and the temperature detection sensor, wherein the controller determines, in a state of the liquid discharger discharging the liquid onto the continuous form sheet being conveyed by the conveyor at a first conveying speed, in response to a seam of the continuous form sheet being detected by the seam detection sensor, whether the heater temperature detected by the temperature detection sensor is higher than or equal to a threshold temperature, wherein the controller causes, in response to the heater temperature being determined to be higher than or equal to the threshold temperature, the conveyor to stop conveying the continuous form sheet, until the heater temperature falls below the threshold temperature, and wherein in response to determining that the heater temperature having fallen below the threshold temperature, the controller causes the conveyor to convey the continuous form sheet at a second conveying speed that is slower than the first conveying speed until the seam of the continuous form sheet is wound up around the winding roller.

2. The liquid discharge device as claimed in claim 1, wherein in response to determining that the heater temperature being determined to be lower than the threshold temperature, the controller causes the conveyor to convey the continuous form sheet at a third conveying speed that is slower than the first conveying speed until the seam of the continuous form sheet is wound up around the winding roller.

3. The liquid discharge device as claimed in claim 1, wherein after the seam of the continuous form sheet was detected by the seam detection sensor, until the seam of the continuous form sheet is wound up around the winding roller, the controller causes the liquid discharger to stop discharging the liquid.

4. The liquid discharge device as claimed in claim 1, further comprising:

an informing unit configured to present information, wherein the controller informs through the informing unit that the heater temperature is high in response to the heater temperature being determined to be higher than or equal to the threshold temperature.

5. The liquid discharge device as claimed in claim 1, further comprising:

a turning unit configured to turn the continuous form sheet upside down, wherein the liquid discharger includes a first liquid discharger arranged on an upstream side of the conveying direction of the continuous form sheet relative to the turning unit, and configured to discharge the liquid onto an upside of the continuous form sheet, and a second liquid discharger arranged on a downstream side of the conveying direction of the continuous form sheet relative to the turning unit, and configured to discharge the liquid onto an underside of the continuous form sheet, where the dryer includes a first dryer arranged between the first liquid discharger and the turning unit in the conveying direction of the continuous form sheet, and configured to dry the liquid adhering to the upside of the continuous form sheet, and a second dryer arranged between the second liquid discharger and the winding roller in the conveying direction of the continuous form sheet, and configured to dry the liquid adhering to the underside of the continuous form sheet.

6. An image forming device comprising:

the liquid discharge device as claimed in claim 1, wherein the liquid discharger discharges ink onto the continuous form sheet, to form an image on the continuous form sheet.

* * * * *